US009943183B1

(12) United States Patent
Carter, Jr.

(10) Patent No.: US 9,943,183 B1
(45) Date of Patent: Apr. 17, 2018

(54) ARTICLE FOR THE SUPPORT AND DISPLAY OF WEDDING VEILS AND ACCESSORIES

(71) Applicant: Martha L. Carter, Jr., Richardson, TX (US)

(72) Inventor: Martha L. Carter, Jr., Richardson, TX (US)

( * ) Notice: Subject to any disclaimer, the term of this patent is extended or adjusted under 35 U.S.C. 154(b) by 0 days.

(21) Appl. No.: 15/836,276

(22) Filed: Dec. 8, 2017

Related U.S. Application Data

(63) Continuation-in-part of application No. 15/004,895, filed on Jan. 23, 2016, now Pat. No. 9,839,312.

(51) Int. Cl.

| | |
|---|---|
| ***A47G 25/10*** | (2006.01) |
| ***A47G 25/28*** | (2006.01) |
| ***A47G 25/20*** | (2006.01) |
| ***A47G 25/32*** | (2006.01) |

(52) U.S. Cl.
CPC ..... *A47G 25/10* (2013.01); *A47G 25/20* (2013.01); *A47G 25/28* (2013.01); *A47G 25/32* (2013.01)

(58) Field of Classification Search
CPC .... A47G 25/00–25/38; A47G 25/4007; A47G 2025/1492; A42B 5/00; A42B 1/06
See application file for complete search history.

(56) References Cited

U.S. PATENT DOCUMENTS

| | | | | |
|---|---|---|---|---|
| 2,201,744 | A * | 5/1940 | Shewbridge | A47G 25/0671 248/158 |
| 2,601,074 | A * | 6/1952 | Walton | A47G 25/60 223/86 |
| 2,875,931 | A * | 3/1959 | Monteleone | A47G 25/4007 223/90 |
| 3,790,044 | A * | 2/1974 | Verdile | A47G 25/32 223/86 |
| 4,720,987 | A * | 1/1988 | Moss | E05B 67/00 109/23 |
| 4,944,480 | A * | 7/1990 | Jarrett | A47G 25/0607 248/304 |
| 5,138,720 | A * | 8/1992 | Campbell | A42B 1/16 132/61 |
| 8,695,859 | B1 * | 4/2014 | Stalker | A45F 3/04 135/901 |
| 9,211,023 | B1 * | 12/2015 | Weiss | A47G 25/0614 |

FOREIGN PATENT DOCUMENTS

WO WO 2007147910 A1 * 12/2007

* cited by examiner

*Primary Examiner* — Ismael Izaguirre
(74) *Attorney, Agent, or Firm* — Warren V. Norred; Norred Law, PLLC

(57) ABSTRACT

A wedding veil support and display for the transport and display of wedding veils and accessories includes a display body adapted to fit under a veil, maintain the shape of the veil when transporting the veil, and, in cases where the display body is suspended from anything allowing a hook to hang, support the veil in an upright position such that the veil and any displayed accessories such as jewelry, may be viewed or photographed in a natural state, e.g., the manner in which the veil is intended to be worn, adjacent a bridal gown.

11 Claims, 13 Drawing Sheets

ARTICLE FOR THE SUPPORT AND DISPLAY OF WEDDING VEILS AND ACCESSORIES

BACKGROUND

1. Field of the Invention

The invention relates generally to apparel displays, and more particularly to displays for wedding veils, and wedding veil accessories for storage and merchandising display purposes.

2. Description of Related Art

Veils, worn since ancient times, were designed for both practical considerations, e.g. to afford women a degree of anonymity, and to be symbolic. In Jewish and Christian wedding ceremonies, the veil symbolizes the transition of the bride from an unmarried to a married state when the veil is lifted either by the bride's father, a proxy such as another significant member of the family, or by the groom. While the particular habits of wearing the veil vary by culture, wedding veils, come in a variety of transparencies, shapes, lengths, and trim. Commonly, a wedding veil has an inside upper portion attachable to the hair of the bride which may include a hair comb, clip, or other means of affixment to the hair, and a trailing portion which may include a decorative trim, e.g., lace, chosen to match the bridal gown. A fascinator is an accessory often worn with a veil that may include beads, flowers or other decorative elements as an accent piece.

For many years, and up to the present time, merchandisers of bridal apparel have typically employed a type of veil hanger that includes a hook and a clip attachable to the veil such that the veil is displayed in an inverted state. While such a veil hanger is compact, it is difficult for the shoppers or sales staff to visualize what the veil will look like when mixed and matched with different gowns when the veil is displayed inverted.

It would be desirable to provide a space economizing veil display and support article for displaying wedding veils in an upright position.

It would further be desirable to provide a veil display and support article for an individual bride to display her wedding veil or other headpiece or the combination of the two attached to a wedding veil hanger in an attractive upright position with a convenient external pocket attached on the flat side of the hanger to store her wedding day jewelry. The support article would provide a means for the veil and/or headpiece to hang alongside the bride's wedding gown in the bride's home prior to the ceremony. This provides an attractive display of the veil.

It is further desirable to provide a veil display and support allowing for veils of all lengths, including short or cathedral lengths, to be supported from a variety of fixtures such as door knobs, ceiling fixtures, curtain rods, closet clothes rods, or a nail on the wall.

It would be additionally desirable to provide a veil display and support that prevents the veil from being crumpled and creased during transport by vehicle or hand carried.

It would be desirable to provide a space economizing veil display and support article for displaying wedding veils in an upright position.

It would be furthermore desirable to accommodate the custom of taking professional photographs of wedding gowns prior to the ceremony by providing a veil display article that displays a paired veil and/or other headpiece in a natural state, e.g., upright as it is intended to be worn, next to the wedding gown.

It would be still further desirable to provide an attached external pocket to store the bride's wedding day jewelry (necklace and earrings, etc.) on the flat back portion of the veil display article that would permit the bride the convenience of transporting her veil and jewelry together to the event setting the day of the wedding.

It is even further desirable to provide a veil display allowing for a photographer to display a veil wherever the photographer desires, so long as a structure is provided to receive a swivel hook of the veil display and support. This would allow for the veil to accompany the wedding dress in any and all staging landscapes.

It is further desirable to provide a veil display and support in at least two sizes, allowing for the bride to purchase a size to accommodate the size of her veil and/or head piece.

Accordingly, although great strides have been made in the area of apparel display, many shortcomings remain.

SUMMARY OF THE INVENTION

The present invention includes a space economizing wedding veil support and display that may be displayed with a wedding veil and and/or headpiece employed in merchandizing to optimally display a wedding veil in a natural i.e., upright position, so that the appearance of a paired gown and veil may be quickly appreciated and evaluated and for an individual bride to display her veil along with her gown before the ceremony.

A general embodiment of the invention includes a display body with a rounded portion adapted to fit under any type of hair piece including but not limited to a wedding veil, head piece, headband, flower wreath, tiara, large hair comb(s), birdcage veil, fascinator and decorative hair pins, and configured to hang from a any object that accommodates a hook such as a clothing rod, post, peg, closet door, curtain rod, ceiling fixture, or tall armoire.

In a first aspect of the invention, a substantially planar side of the display body can be adapted to rest stably against a flat surface without rocking from side to side when the veil hanger is stored horizontally and not in use.

In a second aspect of the invention, combinable with any other aspect, the display body includes a hook adapted to hang freely from a rod or post or any object that a hook can hang from.

In a third aspect of the invention, combinable with any other aspect, the display body may include a section of a spherical body adapted for placement under the veil or head piece.

In a fourth aspect of the invention, combinable with any other aspect, the display body may include a section that is a one half sphere adapted for placement under the veil or head piece.

In a fifth aspect, combinable with any other aspect, the display body may include a section that is a one quarter section of a sphere adapted for placement under the veil or head piece.

In a sixth aspect, combinable with any other aspect, the display body may include an external attached secured pocket for storing bridal accessories and other small items.

In a seventh aspect, combinable with any other aspect, the display body may include a substantially planar bottom side for resting on a flat surface such as a countertop.

In an eighth aspect, combinable with any other aspect, the display article may have t-pins or any suitable fasteners to attach the veil and/or headpiece to the porous display body.

In a ninth aspect, combinable with any other aspect, the display body may include a tether with snaps or other fastening members, in place of a swivelable hook for suspension from a clothing rod, a post, a knob or the like.

In a tenth aspect, combinable with any other aspect, the display body may include a hook that hinges, folds, or pivots toward the display body for storing or shipping purposes.

In an eleventh aspect combinable with any other aspect, the display body may include a padding or batting covered with a solid fabric with a lace fabric overlay or any suitable material.

In a twelfth aspect, combinable with any other aspect, the curved portion of the display body may be covered in fabric penetrable by t-pins, and the flat portion(s) may or may not be covered in fabric but a molded plastic or any feasible material.

In a thirteenth aspect, combinable with any other aspect, the display body may include a pocket attached by sewing or gluing to the outside portion of the flat side of the body secured with a closure flap with a snap or Velcro, elastic gather about the pocket opening, or a zipper or any type of secure fastener to store jewelry and other small items.

In various embodiments, an open or sealable compartment of the hanging body may be sub-compartmentalized.

In various embodiments, an open or sealable compartment of the hanging body may be lined with for example a soft material or lacking a lining.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
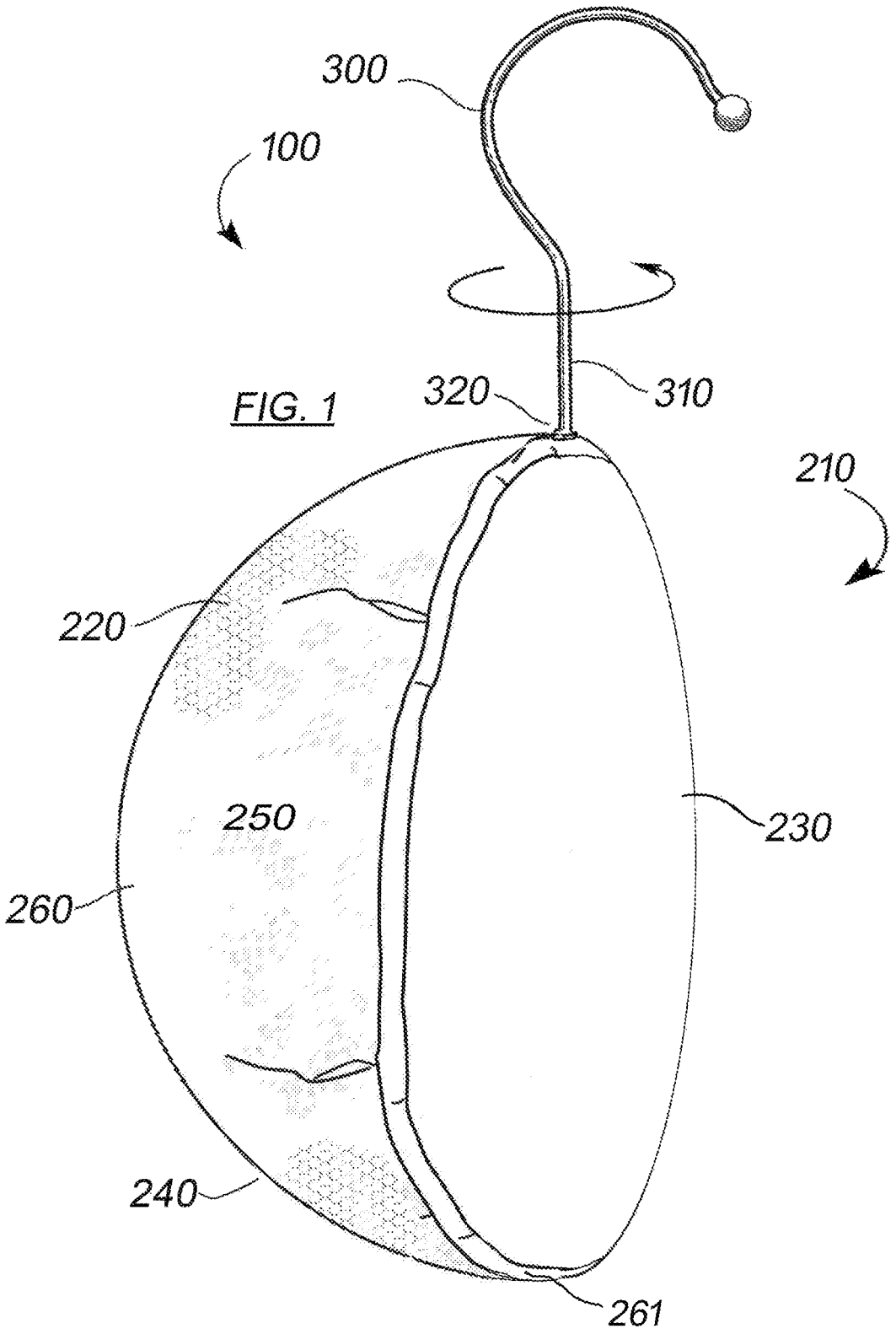
FIG. 1 is a perspective view of one embodiment of a one-half sphere display article.
Figure 2:
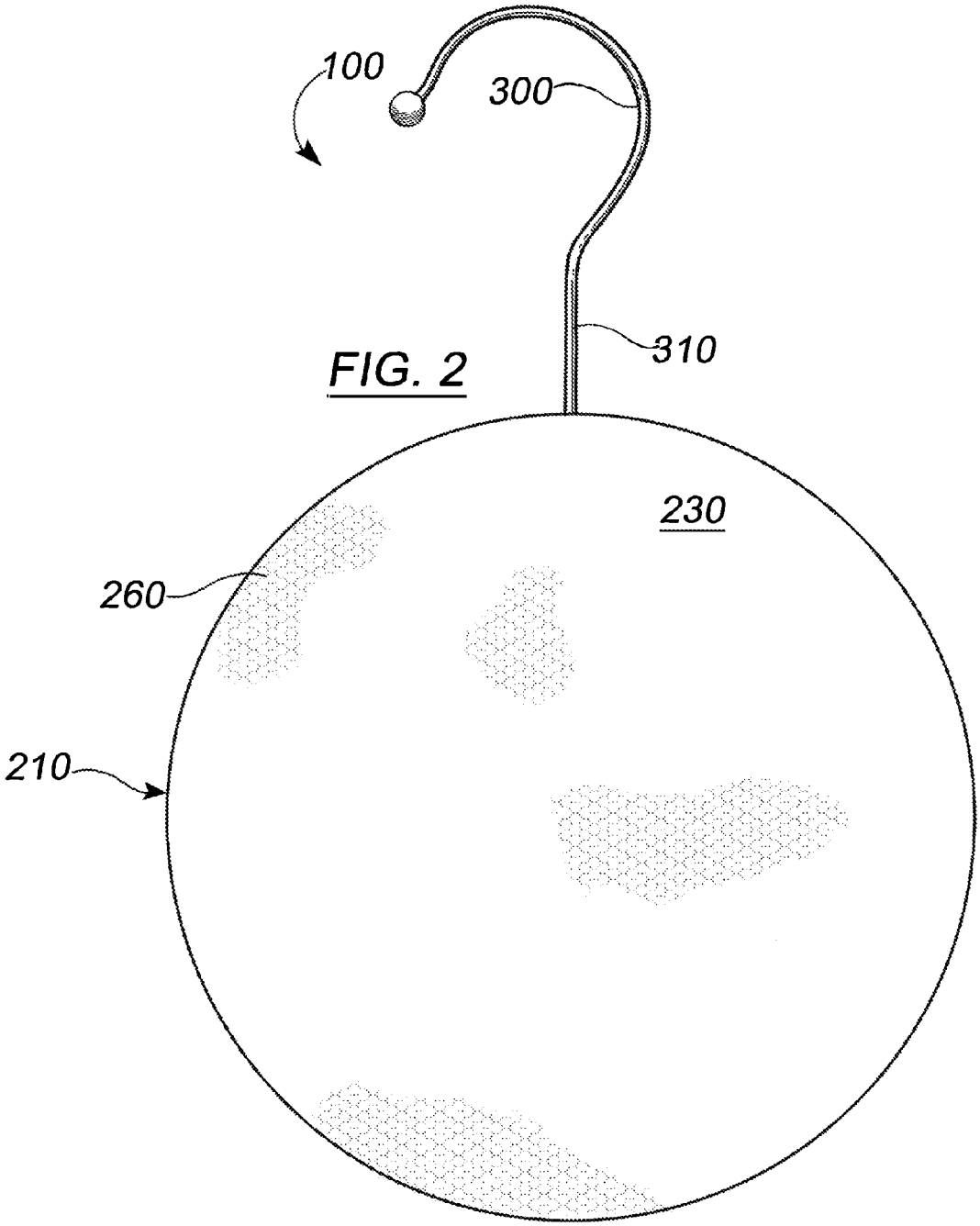
FIG. 2 is a back plan view of the one half sphere thereon.
Figure 3:
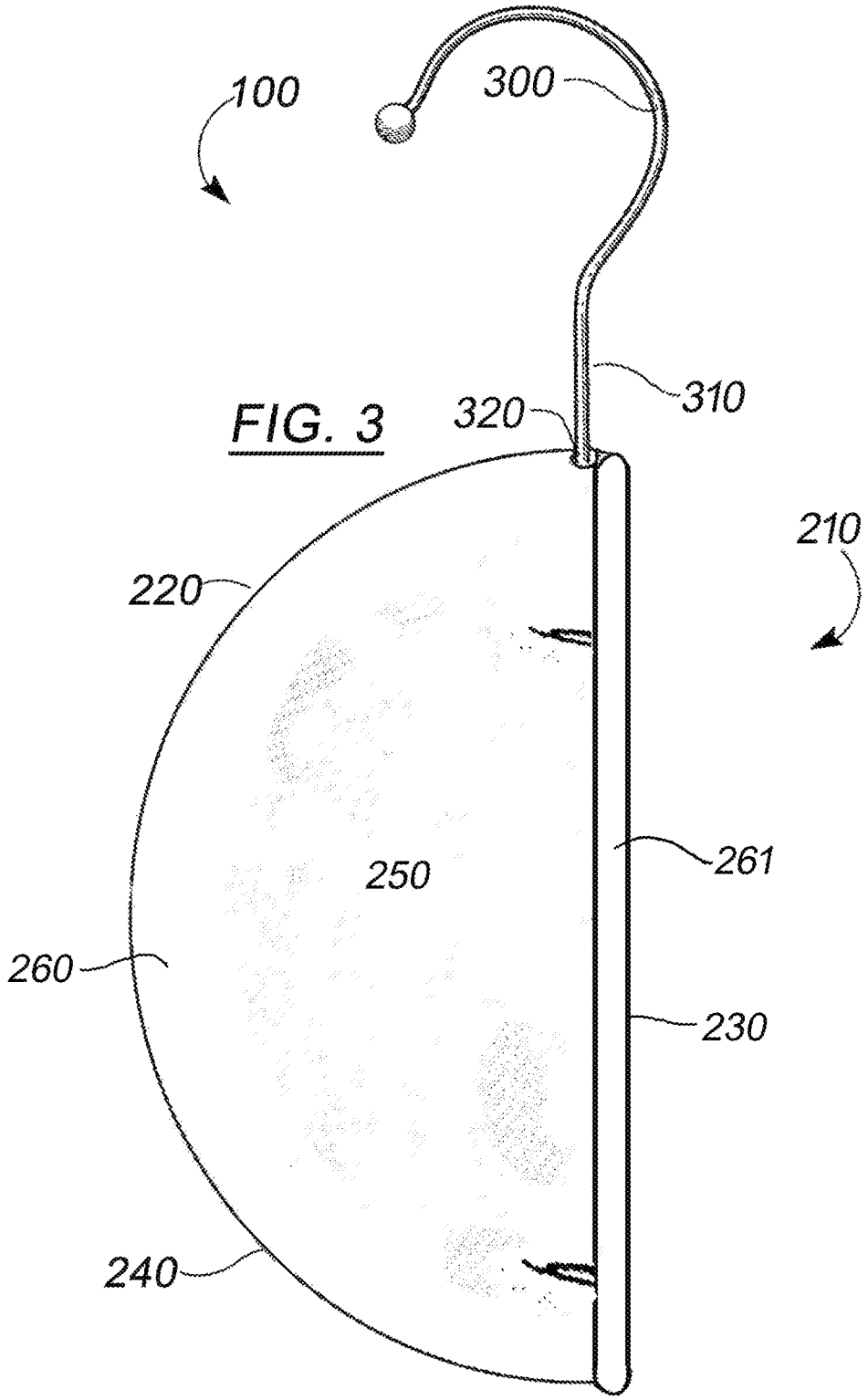
FIG. 3 is a side elevation view of the one-half sphere display article thereon.
Figure 4:
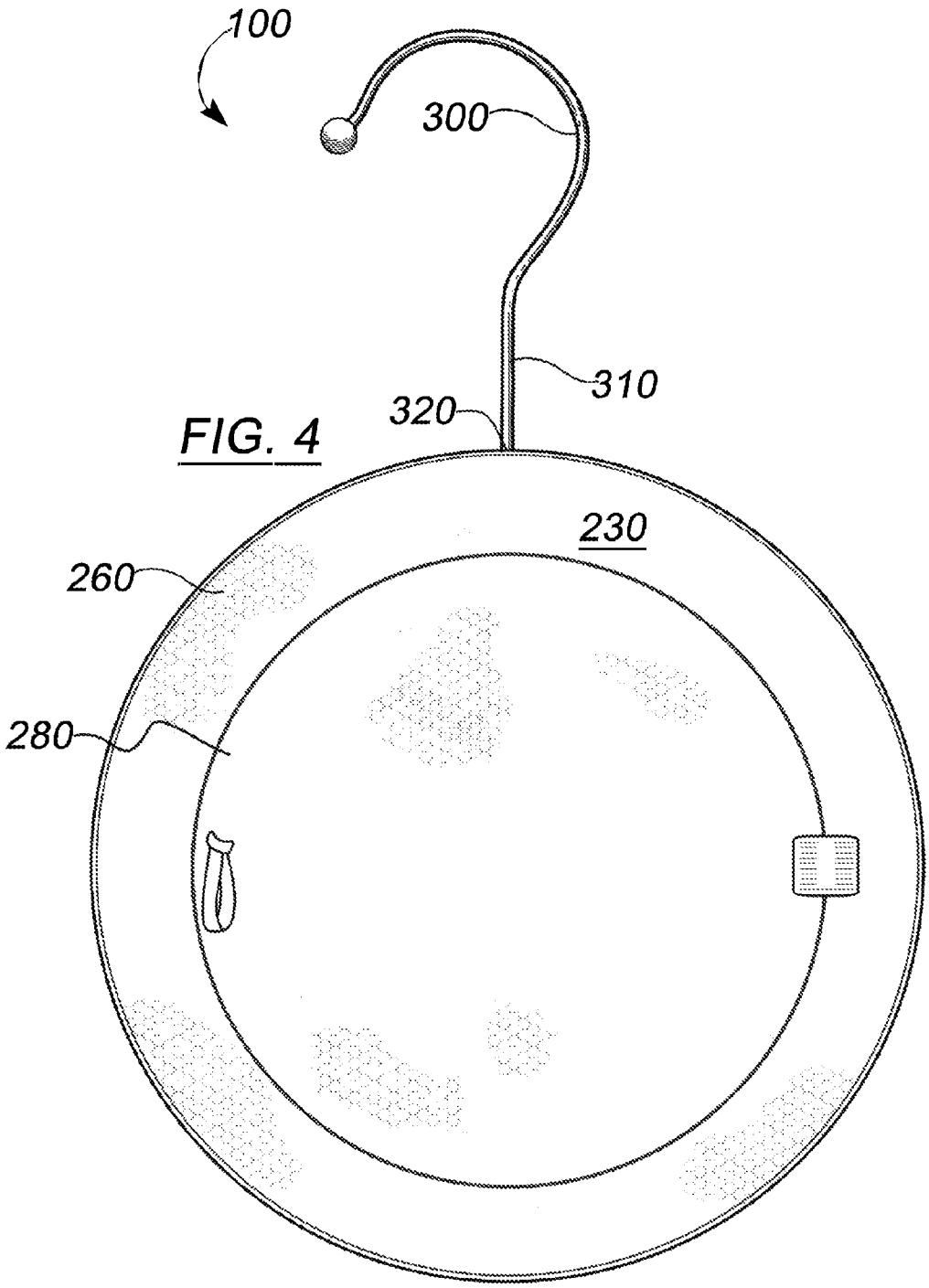
FIG. 4 is a back plan view of a one half sphere thereof showing access panel 280.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Reference listing of the named elements.

100 display article
200 one quarter article body
210 one half article body
220 body upper portion
230 body back portion
235 one quarter bottom portion
240 one quarter and one half body lower portion
250 body core
260 covering
261 cording
262 stitching
270 compartment
273 material layer
274 pocket
276 elastic
277 gathers
278 pocket flap
279 zipper
280 access panel
290 panel latch
300 hook
310 post
320 swivel and/or pivot member
400 clothing rod
410 peg
500 veil Unless otherwise explained, any technical terms used herein have the same meaning as commonly understood by one of ordinary skill in the art to which this disclosure belongs. The singular terms "a", "an", and "the" include plural referents unless the content clearly indicates otherwise. Similarly, the word "or" is intended to include "and" unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes". All publications, patent applications, patents, and other references mentioned herein, if any, are incorporated by reference in their entirety for all purposes. In case of conflict, the present specification, including explanations of terms, will control. In addition, the materials, methods, and examples are illustrative only and not intended to be limiting.

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-9 depict various views of a storage and display article 100 for the transporting and display of wedding veils and accessories.

In the contemplated embodiment, article 100 includes an article body 210, 200 adapted to fit under a veil 500 so as to support the veil in an upright, i.e., non-inverted position, in order that the veil may be photographed, displayed by a retailer, and/or assessed by a consumer in a natural disposition adjacent to a wedding gown. Further, the veil can be displayed alongside a wedding gown by an individual bride in her home before the wedding day. The article body comes in at least two sizes, namely a one quarter article body 200 and a one-half article body 210. The article bodies 200, 210 include an upper portion for natural disposition adjacent a wedding gown. The article bodies 200 and 210 includes an upper portion 220 that is typically arched and a back portion 230 that includes a planar section. The article bodies 200 and 210 also includes a lower portion 240 which may mirror the upper portion in shape, or be truncated. The outer contours of the display body may resemble a half section of a sphere or a transitional shape between a half section of sphere 210 and a quarter section of a sphere 200.

Article bodies 200 and 210 may include a body core 250 of lightweight, firm porous material such as, Styrofoam, Polystyrene, or any porous material penetrable by t-pins having a molded exterior texture suitable for display, or, the underlying body core of lightweight porous material may include a covering 260 of decorative material that is glued, sewn to, or otherwise affixed curved body core 250 of the one quarter article body 200 or the one half article body 210. Either article body may be penetrable by t-pins or other fasteners to affix a portion of a veil, such as a hair comb, to the display body. The article body may include ties, sewn loops, button holes, hook and loop fasteners or other means for securing a veil or head piece thereto as would be appreciated by those having skill in the art and benefit of the disclosure.

Article bodies 200 and 210 may include a hook 300 adapted to hang over a clothing rod 400, or any object that will allow the hook on the hanger to hang from it. Hook 300 may be in a fixed position for hanging on a clothing rod, or swivel in any direction so that the veil may be turned to face out from clothing rod. Typically hook 300 includes a post 310 that is engaged with the upper portion of the display body via a swivel member 320, which may be any coupling permitting the post to swivel which is molded into or added to the article body at any stage of manufacture.

In various embodiments of the present invention, a display body 210 may incorporate an attached external secured pocket 274 secured with a flap and snap 278 or Velcro, elastic 276, zipper 279, or any appropriate closure sized and shaped to store jewelry and/or wedding veil accessories, such as pins, hair clips or other small articles for use with the veil.

FIGS. 1-5*b* depict a veil display and support with a display body 210 having a shape resembling that of a half sphere. The rounded portion of display body 210 is adapted to fit under the crest of a veil, where it is typically affixed to the hair comb portion of the veil. Display body 210 can be solid, or possess a compartment (FIG. 5) accessible from the back portion of the body. The display body may be covered with satin or lace as shown, or other material as desired. Hook 300 may be a metal hook as shown, a molded plastic hook, or a flexible strap that forms a hook or loop which may be placed over a clothing rod, post or peg or any object a hook can hang from. Hook 300 may be fixed in place or may swivel about axis of post 310. Hook 300 may be configured to pivot or fold against the body 210 about pivot or swivel connection 320.

Figure 5A:
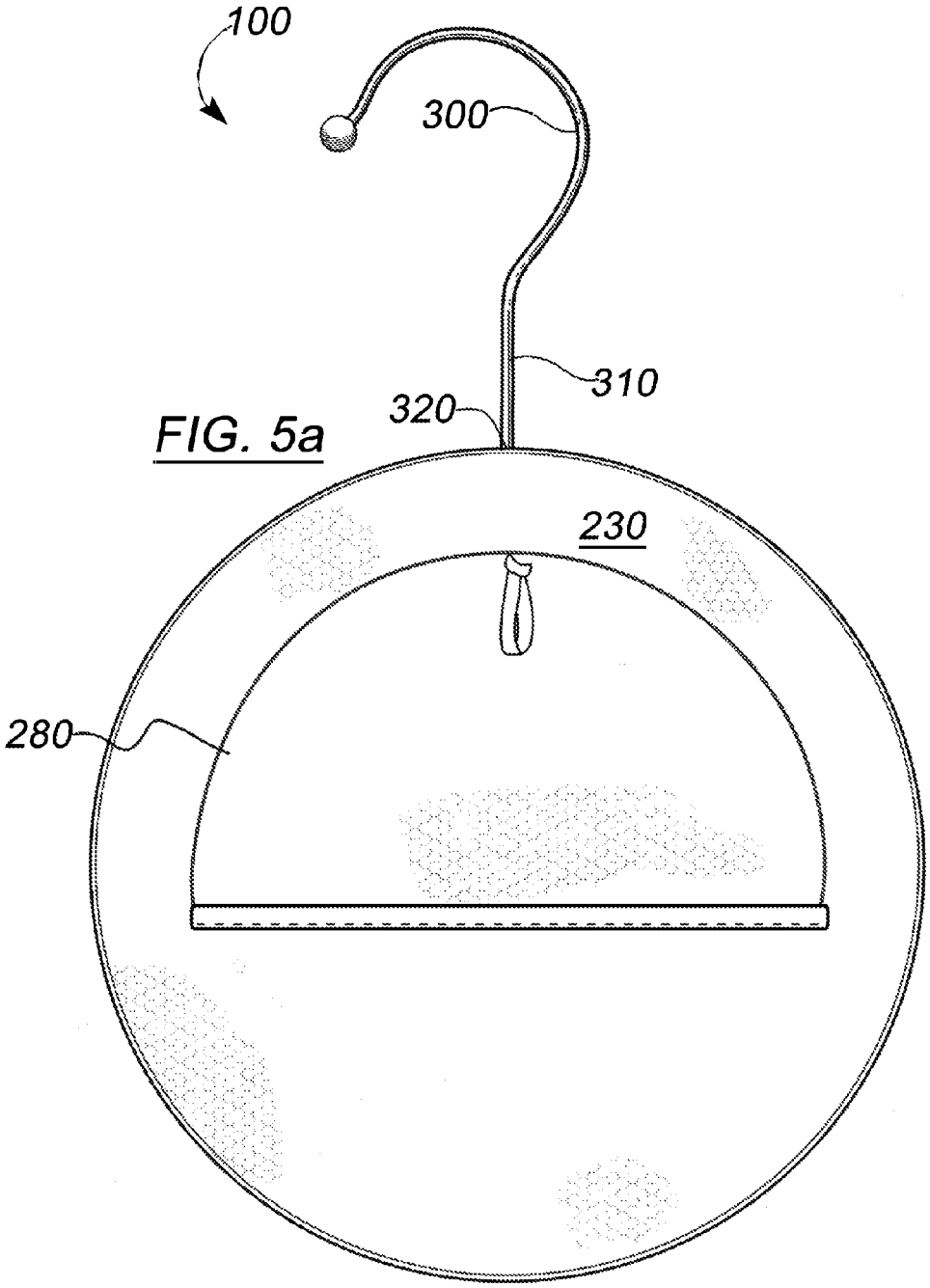
FIGS. 5*a* and 5*b* are respectively back plan views showing access panel 280 closed and opened, revealing a compartment 270.
Figure 5B:
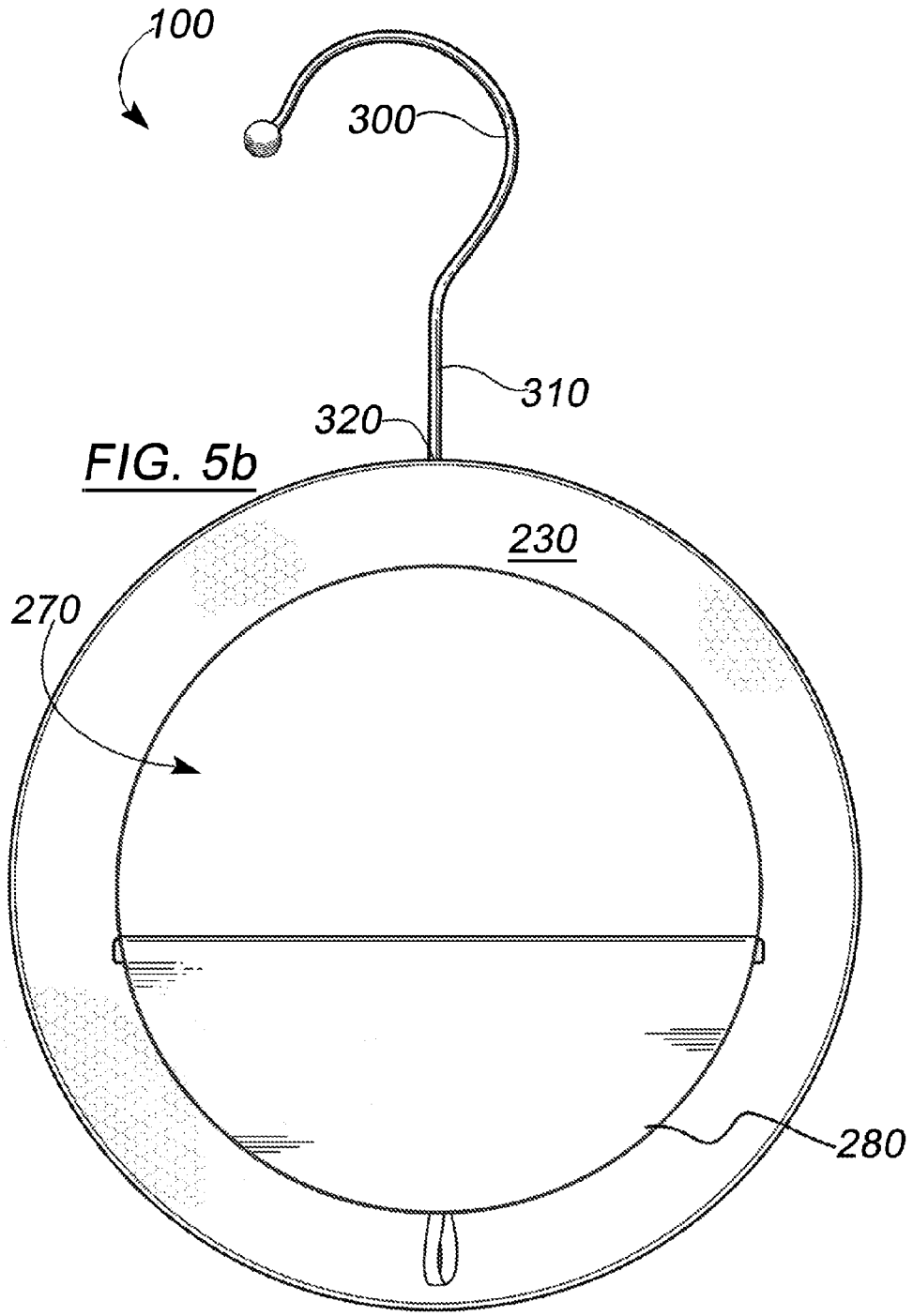
Figure 5C:
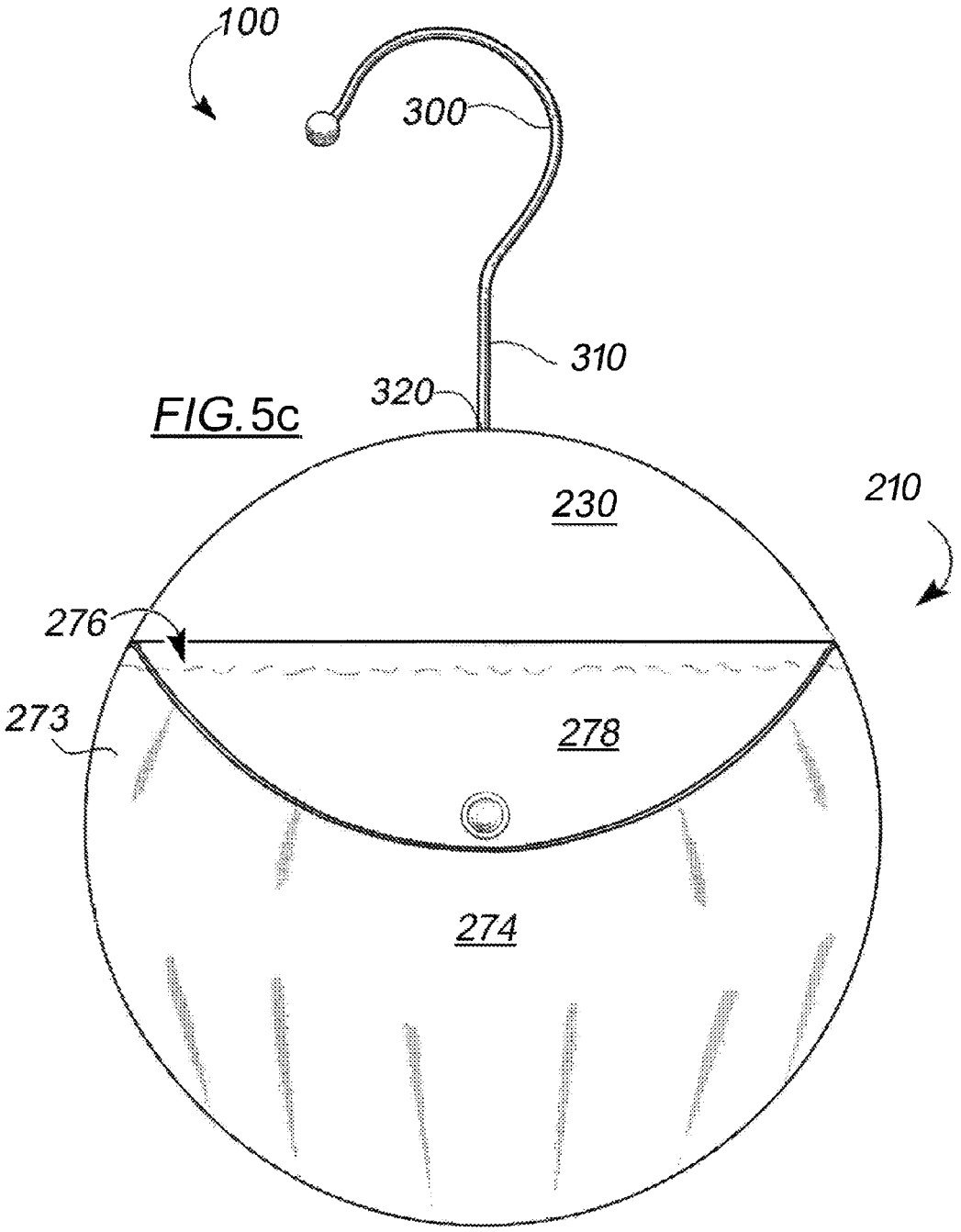
FIGS. 5*c* and 5*d* show respectively a display article with an external pocket 274 with an elastic and flap closure with a snap or Velcro® flap 278, and an external pocket 274 with a gathered elastic opening 276.
Figure 5D:
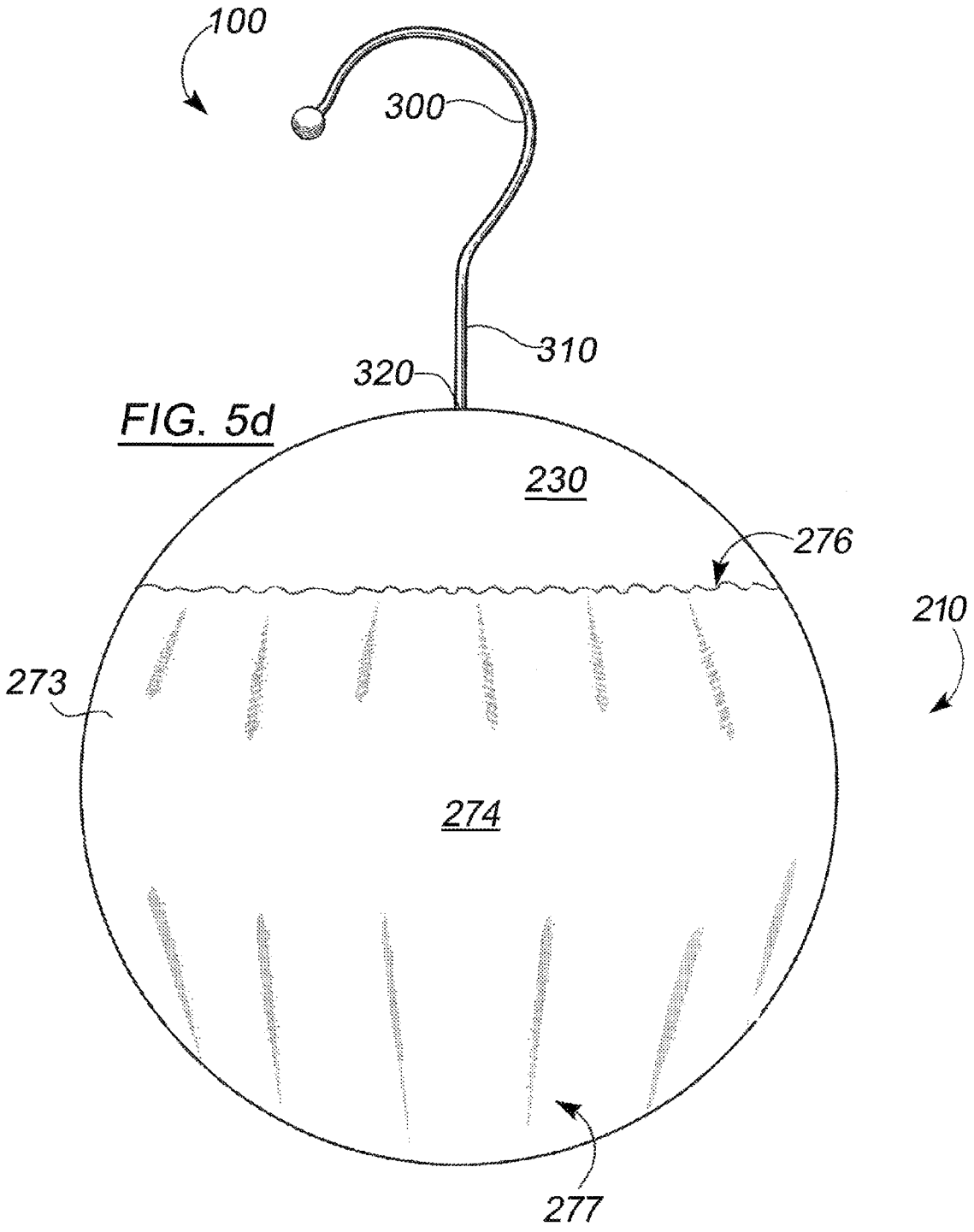

FIGS. 5*c* and 5*d* depicts an externally attached pocket 274 for storing jewelry and/or other accessories to the body back portion 230 with the sides and bottom sewn or glued to the display body 210. The bottom portion 240 is gathered to add fullness while the pocket's top portion 220 has elastic plus a flap and snap or Velcro for a secure closure 278 or strictly an elastic closure 276.

Figure 5E:
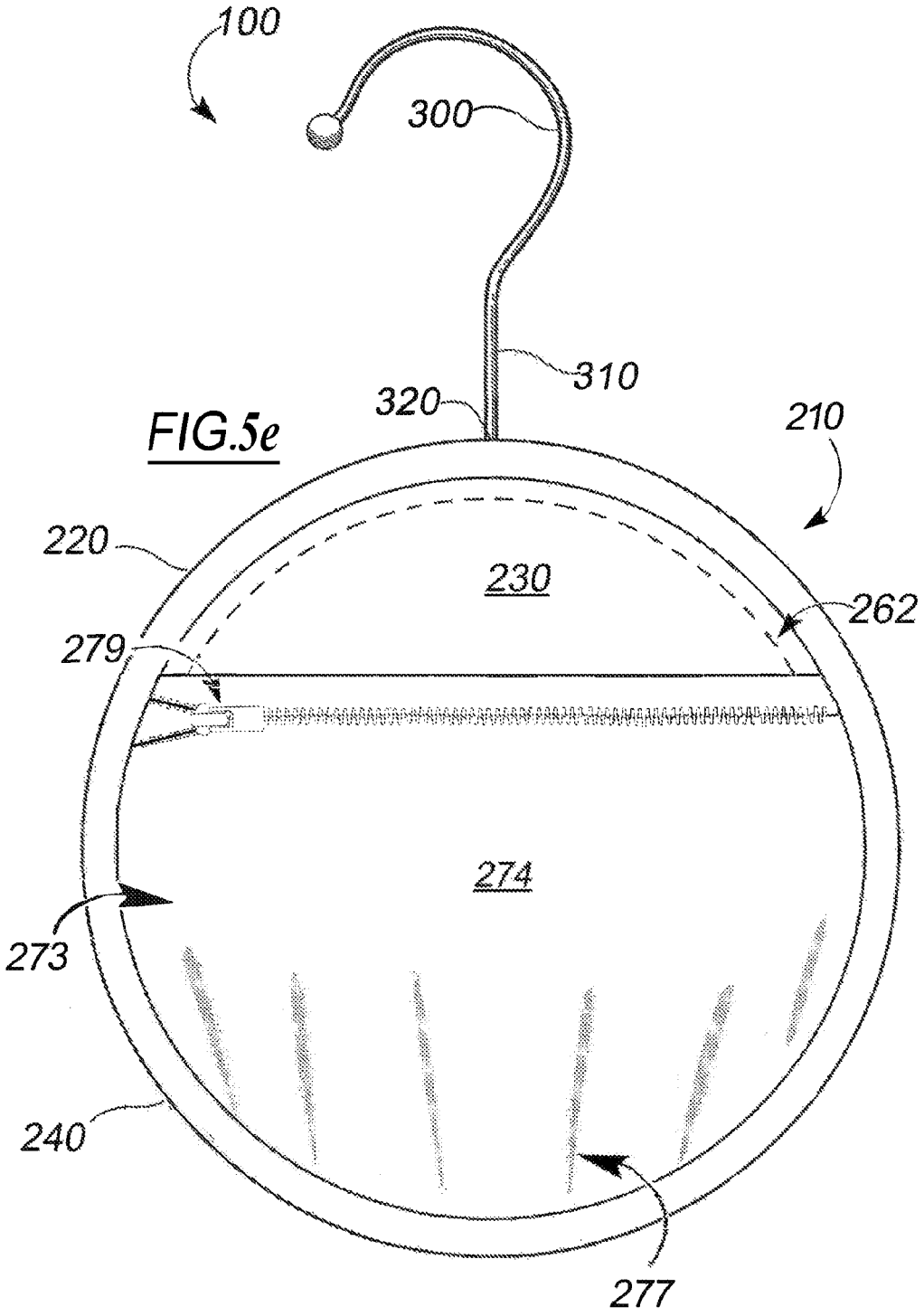
FIG. 5*e* shows a display article with an external pocket 274 with a zipper closure, or any secured external pocket.
Figure 6:
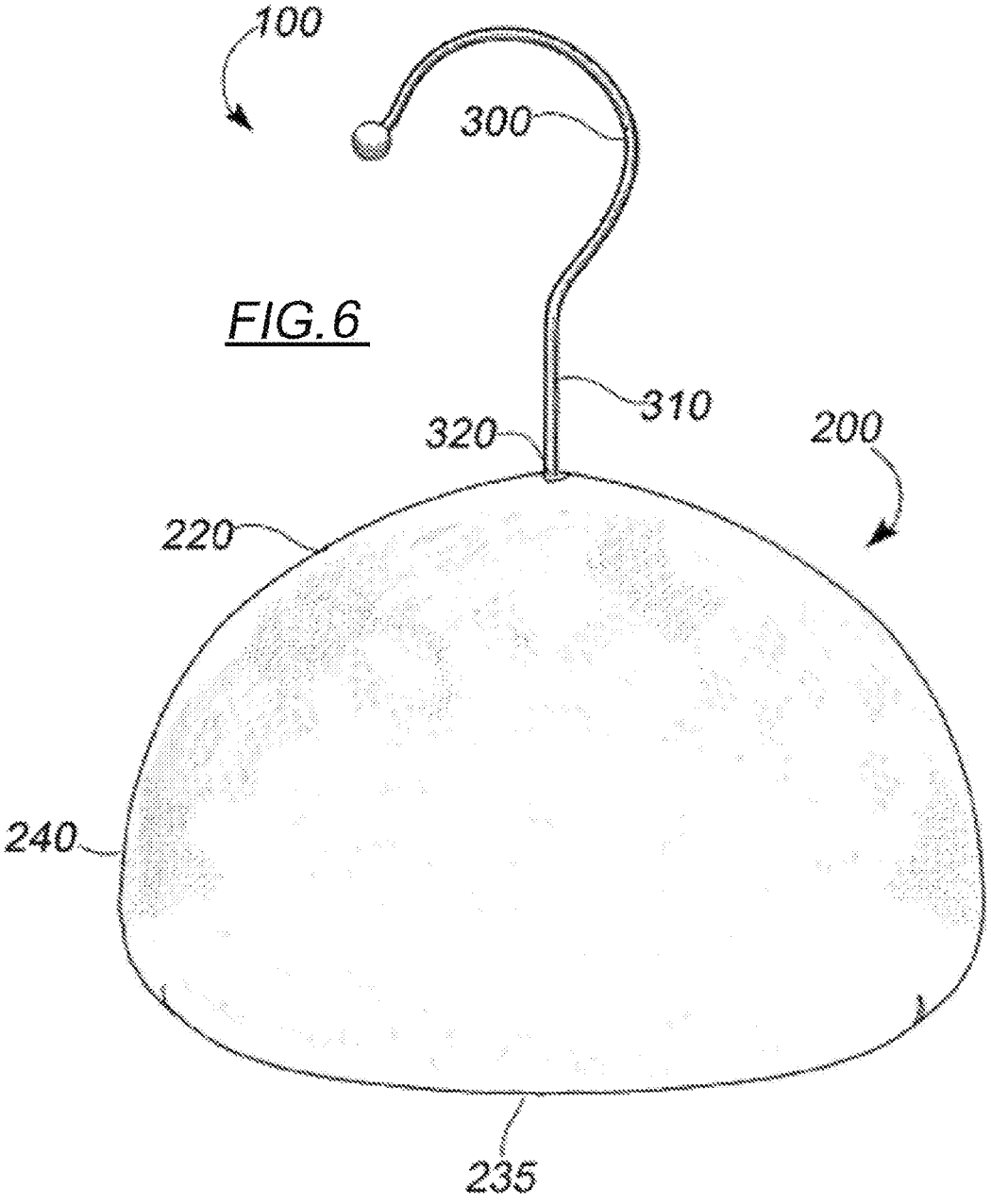
FIG. 6 is a perspective view of a one quarter sphere embodiment of the display article second embodiment thereof.
Figure 7:
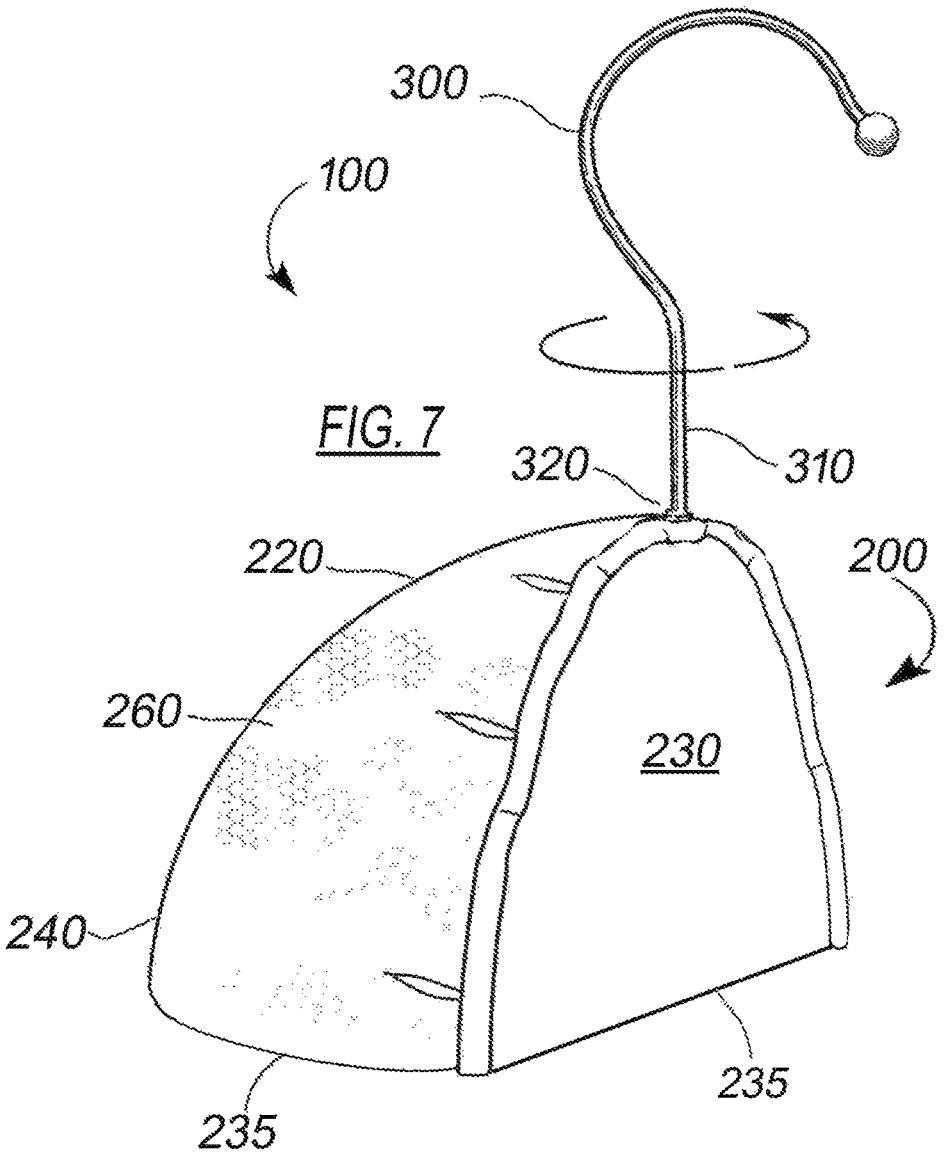
FIG. 7 is a side elevation of a one quarter sphere embodiment of the display article thereof.
Figure 8:
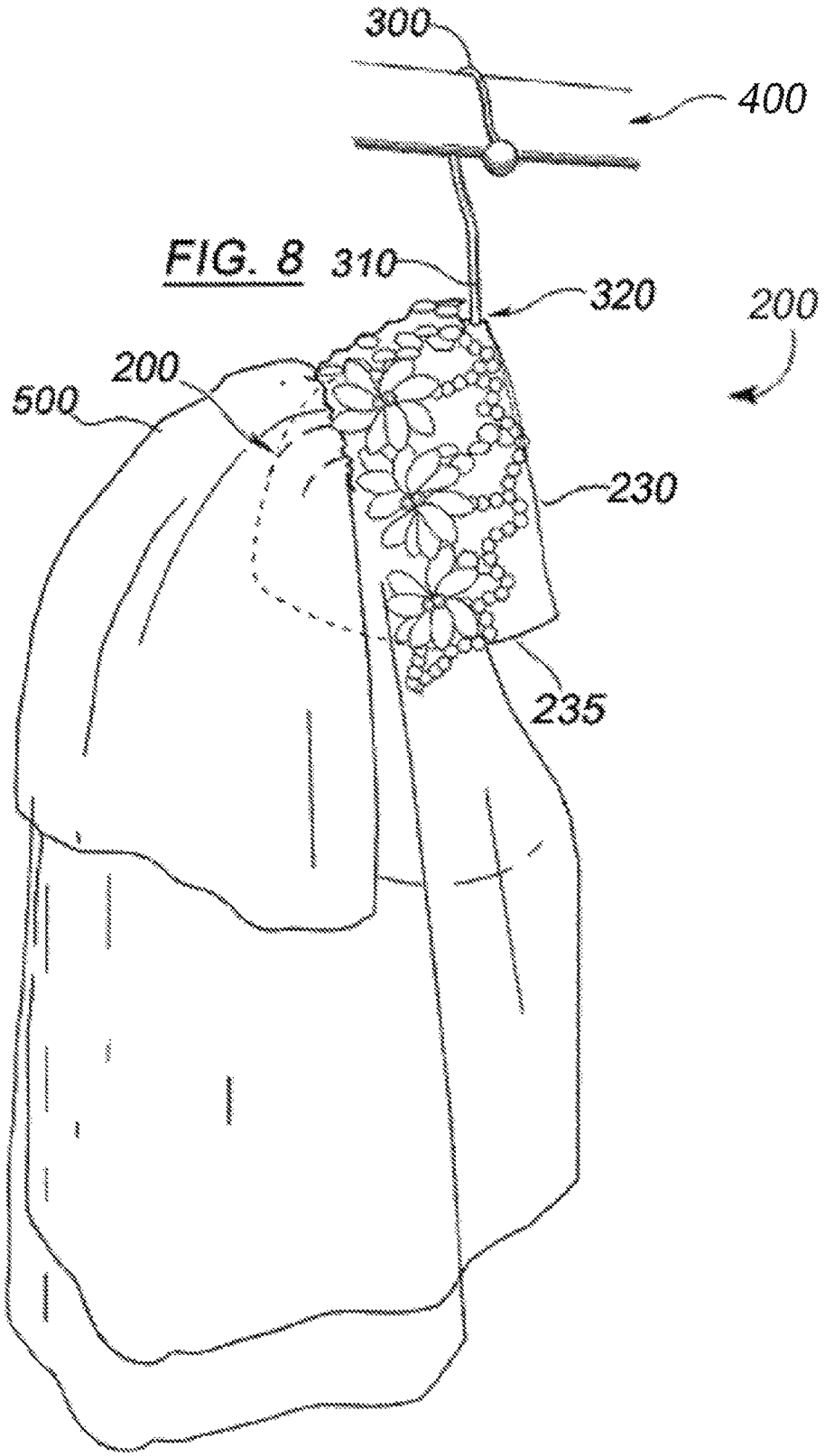
FIG. 8 is a perspective view illustrating a typical use of the display article when suspended from a peg.
Figure 9:
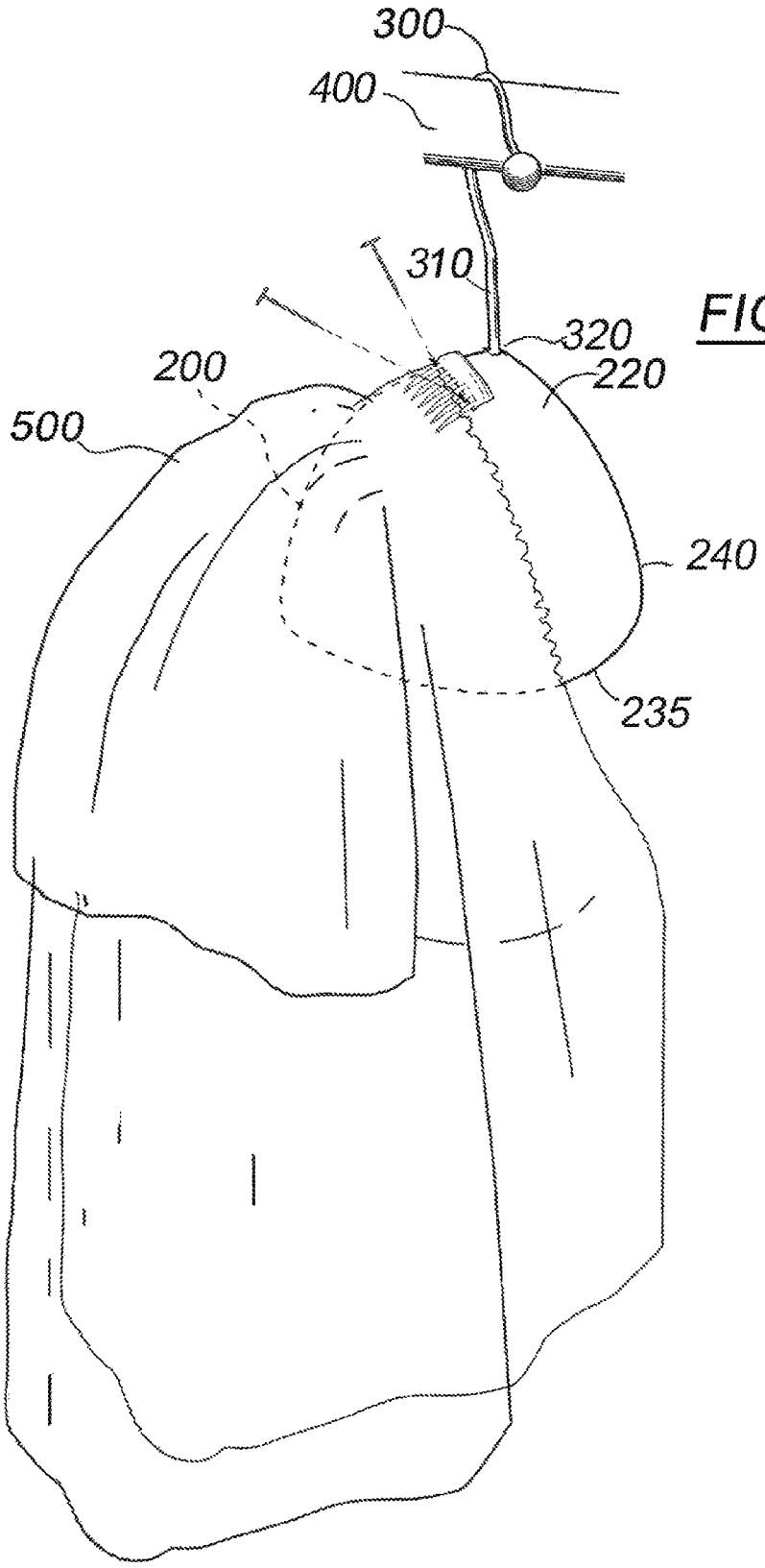
FIG. 9 is another perspective view illustrating how a veil is attached to the veil hanger by inserting T-pins under the veil tulle through the veil's hair comb to the one quarter display article.

FIG. 5*e* depicts an externally attached pocket 274 for storing jewelry and/or other accessories to the body back portion 230. The top portion 220 of the pocket is attached to the body back portion 230 to the one half display body 210 while the bottom portion of the pocket hangs freely. The top portion of the freely hanging portion of the pocket has a zipper 279 to secure the contents of the pocket.

FIGS. 6-9 depict a veil display and support with a display body 200 having a shape resembling that of a quarter sphere that otherwise shares elements of the embodiment shown in (FIGS. 1-5*b*). The one quarter article body 200 may or may not be able to have an attached pocket 274 since the veil hanger is a much smaller size and shape than the one half article body 210.

The following steps outline merely one exemplary method of the manufacture that can be employed to produce the veil display and support article of the invention: Molding a firm foam body such as Styrofoam, Polystyrene, or any firm porous material that can be penetrated by t-pins in the form of a one half 210 section of a sphere with a planar side opposite that of the rounded portion of the section of a sphere or a one quarter section of a sphere with a planar flat side 230 opposite that of the rounded portion of the section of a sphere and a flat bottom section 235, covering the firm porous foam such as Styrofoam, Polystyrene, or any porous material that can be penetrated by t-pins with batting and decorative fabric to the article body 200 and 210; the flat side(s) of 200 and 210 may be covered in fabric or be made of another type of material such as molded plastic; and installing a hook adapted to swivel to an upper portion of the body. It should be understood that excepting the production of the article body, the particular steps outlined above may be performed in any order. A secured pocket may be attached to the body back portion 230 of the one-half sphere 210 and may or may not be added to the one quarter sphere 200 being of a smaller size.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An article for transport, display and merchandising of a wedding veil, the article comprising:

a hook member having a curved upper portion configured to hang from a horizontally disposed rod or post and the hook member having a lower portion with a vertical axis;

a body connected to the hook member adapted to display the wedding veil in a right side up position when the body is suspended from the hook member, the body having:

a bordered first side taking the shape of a section of a sphere and configured to fit under the veil;

a bottom side; and a second side opposite the bordered first side and sharing a border therewith;

wherein the second side has a substantially planar surface for supporting an external attached pocket to store jewelry or accessories.

2. The article of claim 1, wherein the section of a sphere is a one-quarter sphere.

3. The article of claim 1, wherein the section of a sphere is a one-half sphere.

4. The article of claim 1, wherein the hook member is configured to swivel.

5. The article of claim 1, wherein the body further comprises:

an external pocket integrally secured to the second side of the section of the body.

6. The article of claim 1, wherein the hook member is configured to pivot sideways for packaging and shipping purposes.

7. The article of claim 1, wherein the hook member is configured to pivot toward the body for packaging and shipping purposes.

8. The article of claim 1, wherein the body further comprises a fabric covering on the curved side of the hook member.

9. A method of manufacture for an article for the transport of a wedding veil and the merchandising thereof, the method comprising:

providing a body core including a curving portion have a shape of a one half sphere configured to fit under the wedding veil, the body core further includes a bottom portion, a substantially planar back side opposite the curving portion, an uppermost portion, and an externally attached pocket;

attaching a hanger member directly to the uppermost portion of the body core; and covering the body core with a decorative fabric material penetrable by t-pins.

10. The method of claim 9, wherein the body core is penetrable by t-pins.

11. The method of claim 9, wherein the hanger member further comprises:

a post portion configured to pivot or swivel.

* * * * *